United States Patent [19]

Vertegaal

[11] 3,998,158

[45] Dec. 21, 1976

[54] FRICTION AND VIBRATION REDUCING MEANS FOR THIN BLADE SQUEEGEE

[75] Inventor: Jacobus Gerardus Vertegaal, Boxmeer, Netherlands

[73] Assignee: Stork Brabant B.V., Boxmeer, Netherlands

[22] Filed: Oct. 2, 1974

[21] Appl. No.: 511,201

[30] Foreign Application Priority Data

Oct. 2, 1973 Netherlands ..... 7313509

[52] U.S. Cl. ..... 101/120; 15/256.51

[51] Int. Cl.[2] ..... B41F 15/42; B41F 15/44

[58] Field of Search ..... 101/116, 119, 120, 157, 101/169, 123, 129; 15/256.5, 256.51

[56] References Cited

UNITED STATES PATENTS

| | | | |
|---|---|---|---|
| 2,754,796 | 7/1956 | Faulkner, Jr. et al. | 118/44 |
| 3,592,132 | 7/1971 | Weber | 101/119 |

*Primary Examiner*—Edgar S. Burr
*Assistant Examiner*—R. E. Suter
*Attorney, Agent, or Firm*—Edmund M. Jaskiewicz

[57] ABSTRACT

A rotary screen printing machine comprising at least one cylindrical thin walled stencil with an internal squeegee for pressing the printing paste through the perforations of the stencil, said squeegee consisting of a thin metal strip having a covering layer of synthetic material upon the face turned towards the inner wall of the stencil.

3 Claims, 2 Drawing Figures

FRICTION AND VIBRATION REDUCING MEANS FOR THIN BLADE SQUEEGEE

BACKGROUND OF THE INVENTION

My invention relates to a rotary screen printing machine comprising a cylindrical thin walled stencil provided with an internal squeegee for pressing the printing paste through the stencil, the squeegee consisting of a thin resilient metal strip which is secured in a mounting, such a device is known from applicant's copending U.S. Patent application Ser. No. 383,155 now U.S. Pat. No. 3,933,093 issued Jan. 20, 1976.

The use of a metal squeegee marks a great advantage in this technique. The uniformity of the printing work was improved thereby and it was furthermore possible to vary the angle between the squeegee strip and the inner wall of the stencil over a greater interval. Also a noticeable saving of weight was achieved which in practice is of importance when the squeegee is mounted and dismounted.

In use of this new squeegee type a sympton is brought to light which so far has not been observed. This sympton consists of a vibration of the squeegee strip which is produced in a situation of so called marginal layer spreading between the squeegee strip and the stencil. This situation arises when the pressure in the dye paste is insufficient to lift the squeegee strip far from the stencil. The aforementioned marginal layer spreading is produced when the distance between the squeegee strip and the stencil is in the same order of magnitude as the unevennesses consisting of the roughness of the stencil and the squeegee blade.

In case of marginal layer spreading the sympton occurs that the force of friction increases when the relative velocity between the squeegee and the stencil decreases. The squeegee will in that case be slightly pulled along in the direction of the rotating stencil. The force of retention of the squeegee support increases and as a consequence of its elasticity, the squeegee blade moves back again, while the relative velocity between the squeegee blade and the stencil increases and the friction decreases. As soon as this return movement is terminated the relative velocity decreases again and the friction increases. As a consequence a vibration is produced which causes undesired variations in the printing intensity.

SUMMARY OF THE INVENTION

It is an object of my invention to avoid this vibration symptom from occurring. I realize this with the arrangement that the squeegee on the face of the strip, which in operation is convex, a cover is provided consisting of a material which in the non-dry condition is low in friction. As a consequence of this cover the so-called wet friction will decrease by at least 50 percent, whereby the vibration symptom is efficiently eliminated. A further advantage consists in that due to the lower friction a higher force of pressure becomes possible whereby the uniformity with which the dye is pressed through the stencil is promoted.

According to a very simple and at the same time efficient embodiment the cover consists of a strip of synthetic material with a width which is less than half the width of the metal strip, protruding from the mounting, while this synthetic strip is disposed along the free edge of the metal strip.

SURVEY OF THE DRAWINGS

DESCRIPTION OF A PREFERRED EMBODIMENT

Figure 1:
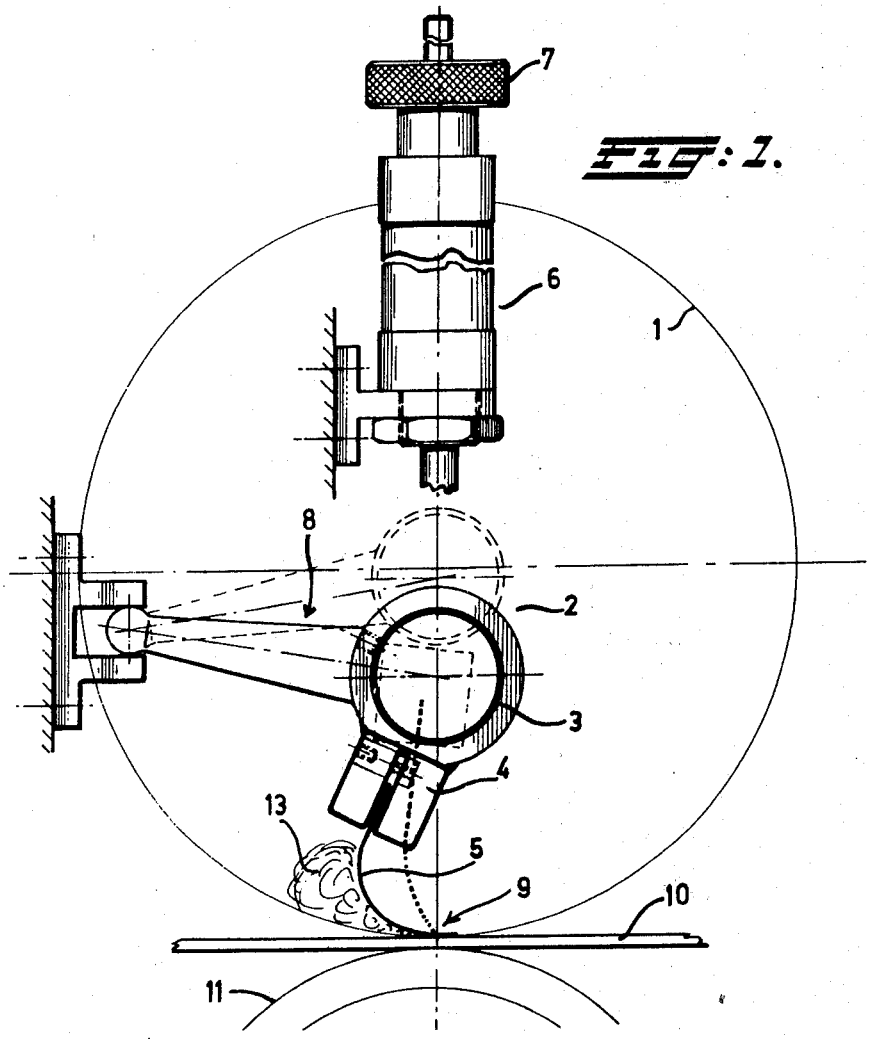
FIG. 1 is a cross section perpendicular to the center line of a stencil and showing a part of a rotary screen printing machines.

The rotary screen printing machine a part of which is only represented in FIG. 1 is of the type which more in detail is described in U.S. Pat. Nos. 3,420,267 and 3,718,086 to assignee as well as in assignee's U.S. patent applications Ser. No. 108,394 (now abandoned) and Ser. No. 383,155 now U.S. Pat. No. 3,933,093 issued Jan. 20, 1976. Such a machine comprises at least one, but mostly eight to 12 cylindrical thin-walled stencils 1 which each are provided with an inner squeegee 2. In the illustrated case this squeegee consists of a supporting pipe 3, a mounting 4 and a thin resilient metal strip 5. The pipe 3 is supported at its two ends, protruding on either side of the stencil, by a supporting device 6 constructed as a pneumatic cylinder with inner spring (not shown). As indicated in FIG. 1 the squeegee strip 5 can assume various positions in dependence of the nature of the printing work aimed at. The adjustment of these positions can be effected by means of a handwheel 7.

The squeegee 2 is further provided with a guide 8 (known from the above-mentioned U.S. patent application Ser. No. 383,155) which ensures that the area of contact 9 of the squeegee strip 5 is always at the same location independent of the angle of deflection of this strip. Each stencil 1 can cooperate with a supporting belt 10 on which the material to be printed (textile, paper of synthetic material) is supported. A supporting roller 11 is disposed under the belt 10 and under each stencil 1. So far the machine corresponds with the state of the art as mentioned hereinbefore.

According to my invention the squeegee 2 is provided with a cover 12 of a material which in the non-dry condition is low in friction. This cover 12 is on the face of the strip, which in operation is convex. In FIG. 1 this means that the cover 12 is in the vicinity of the lower end of the strip 5 on the side which is directed toward the inner wall of the stencil 1, which side is in contact with the printing paste or dye 13.

Figure 2:
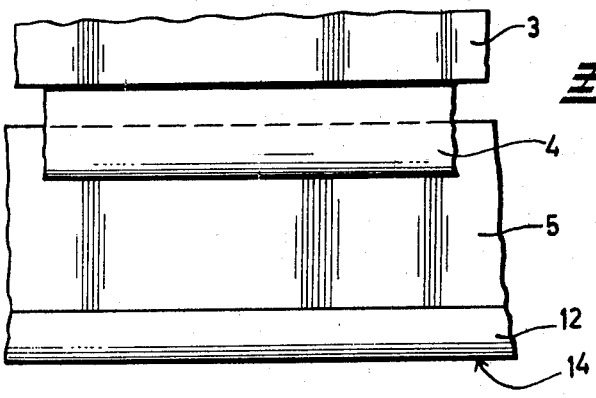
FIG. 2 is a view of a part of a squeegee strip.

In the embodiment according to FIG. 2 the cover 12 consists of a strip of synthetic material with a width which is less than the half of the width of the metal strip 5, protruding from the mounting 4. This strip is disposed along the free edge 14 of the strip 5. The strip can further consist of a polyolefin which has the property that in a wet environment the friction is about 50 percent of that of the steel of which the strip is made.

The cover 12 according to my invention is advantageous because the force of friction exerted on the squeegee 2 by the rotating stencil 1 decreases considerably. As a consequence the vibration of the squeegee as described above, which occasionally is produced will be limited to a minimum or even entirely eliminated. Due to the elimination of the vibration the variations in printing produced thereby are also avoided. Furthermore a greater pressure force of the squeegee can be applied (due to the considerably reduced friction) so that the dye is passed better and more uniformly through the stencil. It has also been found that due to the reduced braking effect of the squeegee on the stencil the consecutive stencils operate in such a way that there is a lesser risk of breaking the repeat design.

What I claim is:

1. An internal squeegee for pressing paste through a cylindrical thin walled stencil of a rotary screen printing machine and comprising a mounting, a thin resilient metal strip secured in said mounting with a portion thereof freely protruding from said mounting and said protruding portion having a free edge, said strip having a thickness less than 1 percent and greater than 0.1 percent of the width of said freely protruding portion of the strip, the protruding portion of said strip being deflected when in operation such that the face of said strip directed toward said inner wall of the stencil and in contact with the paste is convex, and a covering layer consisting of a synthetic material having a low friction when in the non-dry condition along the free edge of said convex face of said strip to reduce friction exerted on the squeegee by the rotating stencil thereby eliminating vibration of the metal strip.

2. An internal squeegee according to claim 1 in which the covering has a width transverse to the strip free edge which is less than half the width of the metal strip protruding from the mounting.

3. An internal squeegee according to claim 2, in which the synthetic strip protrudes freely beyond the free edge of the metal strip over a distance which is at least equal to the thickness of the synthetic strip.

* * * * *